US008915727B2

(12) United States Patent
Tanaka

(10) Patent No.: US 8,915,727 B2
(45) Date of Patent: Dec. 23, 2014

(54) ROTARY COMPRESSOR WITH SPRING HOLDER PIN

(75) Inventor: Junya Tanaka, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 836 days.

(21) Appl. No.: 13/070,171

(22) Filed: Mar. 23, 2011

(65) Prior Publication Data

US 2011/0243778 A1 Oct. 6, 2011

(30) Foreign Application Priority Data

Mar. 30, 2010 (JP) ..... 2010-079428

(51) Int. Cl.
*F04C 15/00* (2006.01)
*F04C 18/356* (2006.01)
*F01C 21/08* (2006.01)

(52) U.S. Cl.
CPC ..... *F04C 18/3564* (2013.01); *F01C 21/0845* (2013.01)
USPC ..... 418/248; 29/888.02; 29/888.025

(58) Field of Classification Search
CPC .. F04C 23/001; F04C 23/008; F04C 18/3564; F04C 29/00; F04C 15/00; F01C 21/0863; F01C 21/0809; F01C 21/0845; F01C 1/0845
USPC ..... 418/5, 7, 11, 210, 215, 248; 29/888.02, 29/888.025, 888
See application file for complete search history.

(56) References Cited

U.S. PATENT DOCUMENTS 5,542,831 A * 8/1996 Scarfone ..... 29/888.025
6,692,242 B2 * 2/2004 Matsumoto et al. ..... 418/248
2007/0071628 A1 * 3/2007 Newland ..... 418/125
2008/0056925 A1 * 3/2008 Lee ..... 418/224
2010/0054978 A1 3/2010 Ueda et al.

FOREIGN PATENT DOCUMENTS

| | | | |
|---|---|---|---|
| CN | 101666314 | A | 3/2010 |
| EP | 2 161 454 | A2 | 3/2010 |
| JP | 57-204487 | U | 12/1982 |
| JP | 63-171683 | U | 11/1988 |

(Continued)

OTHER PUBLICATIONS

Extended European Search Report issued in European Patent Application No. EP 11158472.8 dated Aug. 11, 2011.

(Continued)

*Primary Examiner* — Mary A Davis

(74) *Attorney, Agent, or Firm* — McDermott Will & Emery LLP

(57) ABSTRACT

According to one embodiment, a rotary compressor includes a compressing unit provided with a cylinder having a flared portion to provide a vane groove. In the compressing unit, a piston revolves along a cylinder inner wall, and an operation chamber is formed between the cylinder inner wall and the piston. A vane protrudes from the vane groove into the operation chamber and comes in contact with the annular piston to partition the operation chamber into an inlet chamber and a compression chamber. A spring inserted in a spring hole formed in the back of the vane groove presses the back of the vane. A spring holder pin is inserted in a pin hole located on the outer circumferential side of an end of the vane groove and crossing the spring hole to prevent the spring from coming off the spring hole when the compressing unit is installed in the housing.

1 Claim, 3 Drawing Sheets

(56) References Cited

FOREIGN PATENT DOCUMENTS

| | | |
|---|---|---|
| JP | 05-149281 | 6/1993 |
| JP | 05-223082 | 8/1993 |
| JP | 10-061576 | 3/1998 |
| JP | 2010-038084 | 2/2010 |

OTHER PUBLICATIONS

Chinese Office Action issued in Chinese Application No. 201110079279.3 dated Jul. 2, 2014.

* cited by examiner

ROTARY COMPRESSOR WITH SPRING HOLDER PIN

CROSS-REFERENCE TO RELATED APPLICATION(S)

This application is based upon and claims the benefit of priority of the prior Japanese Patent Application No. 2010-079428, filed on Mar. 30, 2010, the entire contents of which are incorporated herein by reference.

FIELD

The embodiments discussed herein are directed to a rotary compressor.

BACKGROUND

For example, Japanese Laid-open Patent Publication No. 2010-38084 discloses a conventional hermetic compressor including a sealed container, a cylinder, a crankshaft, a piston, a vane, and a spring. The cylinder includes a vane groove and located in the sealed container. The crankshaft includes an eccentric portion. The piston is rotatably fitted to the eccentric portion of the crankshaft and eccentrically rotates in the cylinder. The vane is installed in the vane groove of the cylinder and reciprocates in the vane groove while in contact with the piston at the end. The spring pushes the vane from the back against the piston.

Upon assembling the conventional hermetic compressor, the cylinder having the crankshaft, the piston, the vane, and the spring built therein is installed in the sealed container. At this time, the outer circumference side end of the spring protrudes from the cylinder and interferes with the sealed container. Accordingly, the spring is pushed into a spring hole of the cylinder and a pin is inserted in the outer circumference side end of the vane groove to press the outer circumference side end of the spring so that the outer circumference side end of the spring does not protrude from the cylinder.

With the conventional hermetic compressor, a pin is inserted in the outer circumference side end of the vane groove to press the outer circumference side end of the spring. Therefore, there is a need to push the spring deep into the spring hole to compress the spring to nearly solid length. This requires a large pressing force and results in poor assembly workability.

SUMMARY

According to an aspect of an embodiment, a rotary compressor includes a compressing unit including an annular cylinder, a lower end plate and an upper end plate or a partition, an annular piston, a vane, a spring, and a pin hole. The annular cylinder includes a flared portion to provide an inlet hole and a vane groove. The lower end plate and an upper end plate or a partition seal an end of the cylinder. The annular piston is held by an eccentric portion of a rotation shaft rotationally driven by a motor. The annular piston revolves along a cylinder inner wall in the cylinder. An operation chamber is formed between the cylinder inner wall and the annular piston. The vane protrudes from the vane groove provided to the flared portion of the cylinder into the operation chamber and comes in contact with the annular piston to partition the operation chamber into an inlet chamber and a compression chamber. The spring is inserted in a spring hole formed in the back of the vane groove to press the back of the vane. The pin hole is located on the outer circumferential side of an end of the vane groove provided to the flared portion of the cylinder and crosses the spring hole. A spring holder pin is inserted in the pin hole to prevent the spring pushed into the spring hole from coming off when the compressing unit is installed in the compressor housing.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF THE EMBODIMENT

Exemplary embodiments of the present invention will be described in detail with reference to the accompanying drawings.

Figure 1:
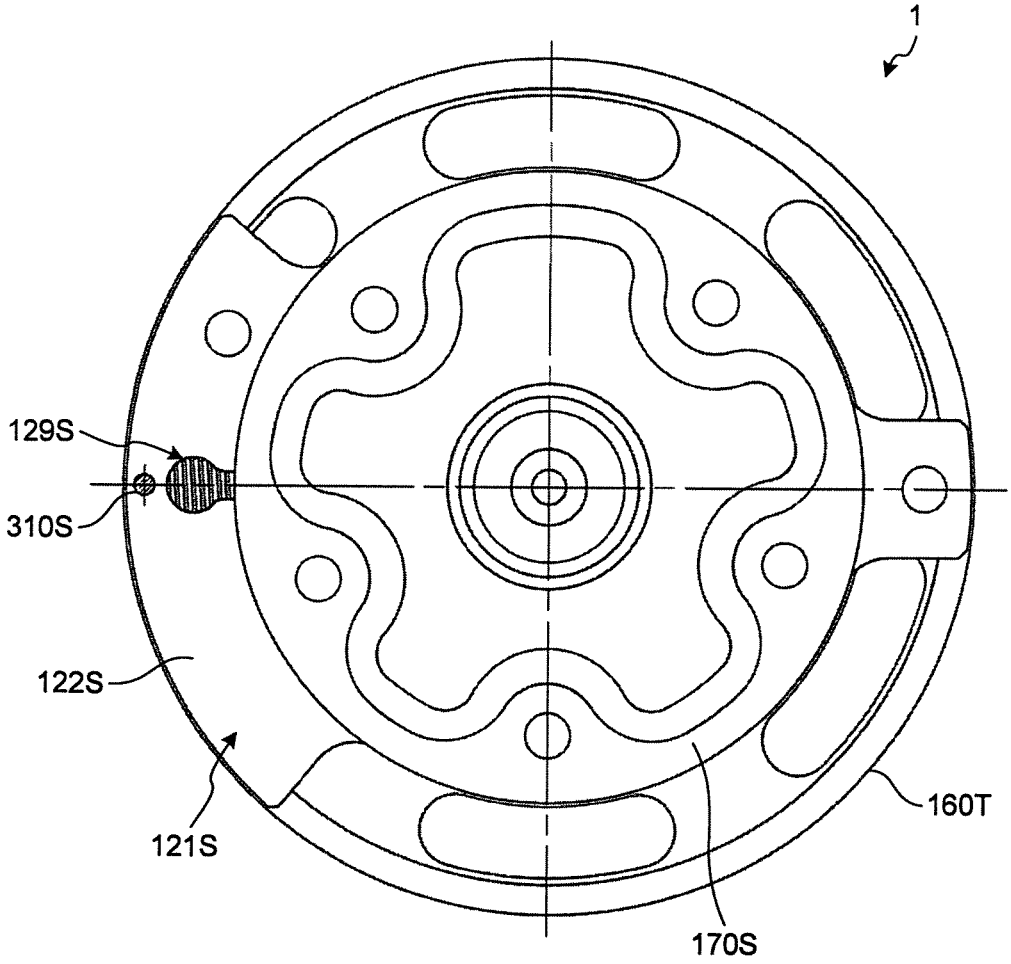
FIG. 1 is a bottom view of a compressing unit of a rotary compressor according to an embodiment.
Figure 2:
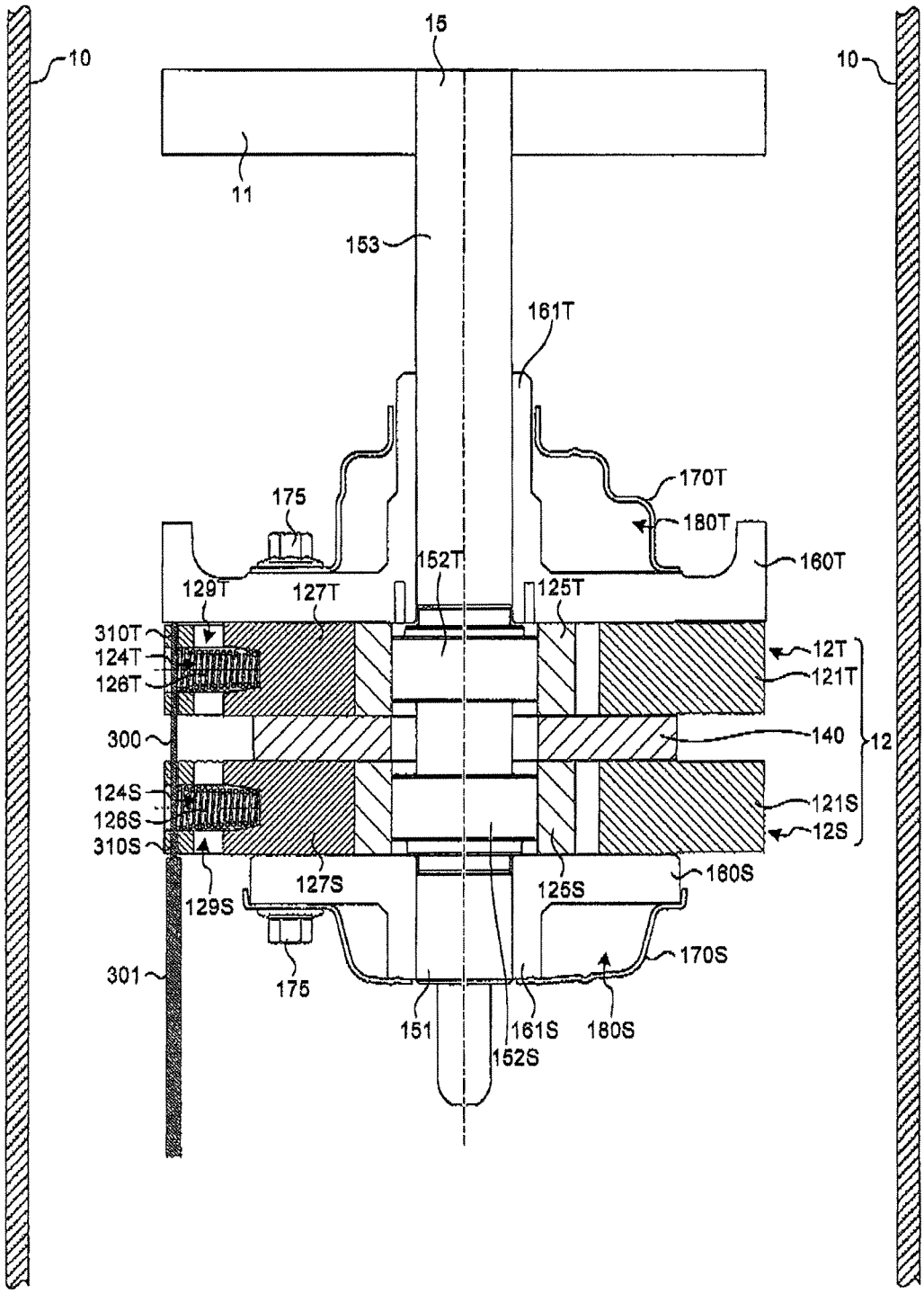
FIG. 2 is a vertical cross-sectional view of the compressing unit of the embodiment.
Figure 3:
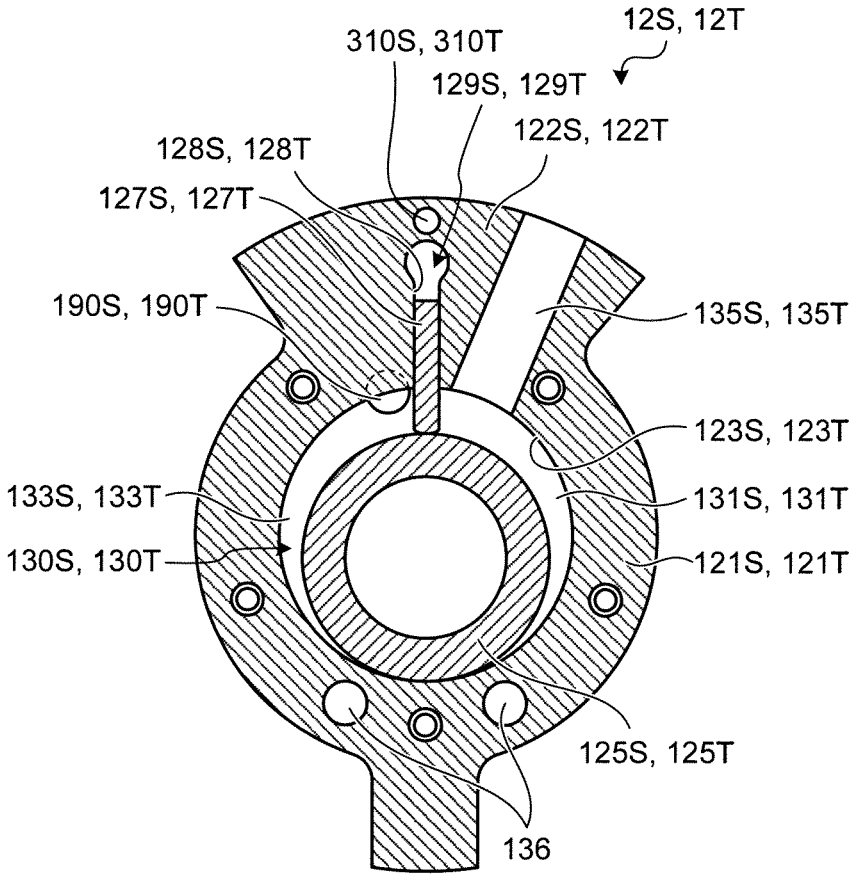
FIG. 3 is a horizontal cross-sectional view of the compressing unit of the embodiment.

FIG. 1 is a bottom view of a compressing unit of a rotary compressor according to an embodiment. FIG. 2 is a vertical cross-sectional view of the compressing unit of the embodiment. FIG. 3 is a horizontal cross-sectional view of the compressing unit of the embodiment.

As illustrated in FIGS. 1 to 3, a rotary compressor 1 of the embodiment includes a compressing unit 12 and a motor 11. The compressing unit 12 is located in the lower part of a compressor housing 10 that is a sealed housing having a vertical cylindrical shape. The motor 11 is located in the upper part of the compressor housing and drives the compressing unit 12 through a rotation shaft 15.

The compressing unit 12 includes a first compressing unit 12S and a second compressing unit 12T. The second compressing unit 12T is arranged in parallel to the first compressing unit 12S and is located above the first compressing unit 12S. The first compressing unit 12S includes a first inlet hole 135S, a first vane groove 128S, and an annular first cylinder 121S having a first flared portion 122S to provide a first back pressure chamber 129S (the end of the first vane groove). Meanwhile, the second compressing unit 12T includes a second inlet hole 135T, a second vane groove 128T, and an annular second cylinder 121T having a second flared portion 122T to provide a second back pressure chamber 129T (the end of the second vane groove).

As illustrated in FIG. 3, a circular first cylinder inner wall 123S and a circular second cylinder inner wall 123T are formed concentrically with the motor in the first cylinder 121S and the second cylinder 121T, respectively. The first cylinder inner wall 123S and the second cylinder inner wall 123T are provided with a first annular piston 125S and a second annular piston 125T, respectively, both having a smaller outer diameter than the inner diameter of the cylinders. A first operation chamber 130S (compression space) is formed between the first cylinder inner wall 123S and the first annular piston 125S. Similarly, a second operation chamber 130T is formed between the second cylinder inner wall 123T and the second annular piston 125T. The first operation chamber 130S and the second operation chamber 130T compress refrigerant gas sucked therein and discharge the compressed gas.

In the first cylinder 121S and the second cylinder 121T, the first vane groove 128S and the second vane groove 128T are formed from the first cylinder inner wall 123S and the second cylinder inner wall 123T along the radial direction over the height of cylinders, respectively. A flat plate-like first vane 127S and a flat plate-like second vane 127T are fitted in the first vane groove 128S and the second vane groove 128T, respectively.

As illustrated in FIG. 2, a first spring 126S and a second spring 126T are located in the back of the first vane groove 128S and the back of the second vane groove 128T, respectively. Usually, by the resilient force of the first spring 126S and the second spring 126T, the first vane 127S and the second vane 127T protrude from the first vane groove 128S and the second vane groove 128T into the first operation chamber 130S and the second operation chamber 130T, respectively, such that the ends are in contact with the outer circumference surfaces of the first annular piston 125S and the second annular piston 125T, respectively. Thus, the first operation chamber 130S (compression space) is partitioned by the first vane 127S into a first inlet chamber 131S and a first compression chamber 133S. Similarly, the second operation chamber 130T (compression space) is partitioned by the second vane 127T into a second inlet chamber 131T and a second compression chamber 133T.

Further, in the first cylinder 121S, the first back pressure chamber 129S (the end of the first vane groove) is formed to allow the back of the first vane groove 128S to be communicated with the inside of the compressor housing to apply a back pressure to the first vane 127S by the pressure of compressed and discharged refrigerant gas. Similarly, the second back pressure chamber 129T (the end of the second vane groove) is formed to allow the back of the second vane groove 128T to be communicated with the inside of the compressor housing to apply a back pressure to the second vane 127T by the pressure of compressed and discharged refrigerant gas.

The first inlet hole 135S and the second inlet hole 135T are provided to the first flared portion 122S of the first cylinder 121S and the second flared portion 122T of the second cylinder 121T, respectively. The first inlet hole 135S and the second inlet hole 135T allow the first inlet chamber 131S and the second inlet chamber 131T to be communicated with the outside, respectively, to suck refrigerant into the first inlet chamber 131S and the second inlet chamber 131T from the outside.

As illustrated in FIG. 2, a partition 140 is placed between the first cylinder 121S and the second cylinder 121T to define the first operation chamber 130S of the first cylinder 121S and the second operation chamber 130T of the second cylinder 121T. A lower end plate 160S is arranged below the first cylinder 121S to close the first operation chamber 130S of the first cylinder 121S. Meanwhile, an upper end plate 160T is arranged above the second cylinder 121T to close the second operation chamber 130T of the second cylinder 121T.

A lower bearing 161S is formed in the lower end plate 160S. The lower bearing 161S rotatably supports a lower bearing support portion 151 of the rotation shaft 15. An upper bearing 161T is formed in the upper end plate 160T. The upper bearing 161T rotatably supports an upper bearing support portion 153 of the rotation shaft 15.

The rotation shaft 15 is provided with a first eccentric portion 152S and a second eccentric portion 152T, the phase of which is shifted by 180° to be eccentric. The first eccentric portion 152S rotatably holds the first annular piston 125S of the first compressing unit 12S. The second eccentric portion 152T rotatably holds the second annular piston 125T of the second compressing unit 12T.

When the rotation shaft 15 rotates, the first annular piston 125S and the second annular piston 125T revolve and rotate clockwise in FIG. 3 along the first cylinder inner wall 123S and the second cylinder inner wall 123T in the first cylinder 121S and the second cylinder 121T, respectively. Following the movement of the first annular piston 125S and the second annular piston 125T, the first vane 127S and the second vane 127T move back and forth. Along with the movement of the first annular piston 125S and the second annular piston 125T as well as the first vane 127S and the second vane 127T, the volume of the first inlet chamber 131S, the second inlet chamber 131T, the first compression chamber 133S, and the second compression chamber 133T continuously changes. As a result, the compressing unit 12 continuously suck in refrigerant gas and compress it, thereby discharging the compressed gas.

As illustrated in FIG. 2, a lower muffler cover 170S is located below the lower end plate 160S such that a lower muffler chamber 180S is formed between the lower end plate 160S and the lower muffler cover 170S. The first compressing unit 12S has an opening to the lower muffler chamber 180S. That is, near the first vane 127S of the lower end plate 160S, a first outlet 190S (see FIG. 3) is provided that allows the first compression chamber 133S of the first cylinder 121S to be communicated with the lower muffler chamber 180S. The first outlet 190S is provided with a first outlet valve (not illustrated) that prevents the backflow of compressed refrigerant gas.

The lower muffler chamber 180S is a circularly communicated chamber and part of a communication passage that allows the discharge side of the first compressing unit 12S to be communicated with the inside of an upper muffler chamber 180T via a refrigerant passage 136 passing through the lower end plate 160S, the first cylinder 121S, the partition 140, the second cylinder 121T, and the upper end plate 160T. The lower muffler chamber 180S reduces the pressure pulsation of discharged refrigerant gas. A first outlet valve holder (not illustrated) is arranged overlapping the first outlet valve to control the flexural opening amount of the first outlet valve. The first outlet valve holder is fixed by a rivet together with the first outlet valve.

As illustrated in FIG. 2, an upper muffler cover 170T is located above the upper end plate 160T such that the upper muffler chamber 180T is formed between the upper end plate 160T and the upper muffler cover 170T. Near the second vane 127T of the upper end plate 160T, a second outlet 190T (see FIG. 3) is provided that allows the second compression chamber 133T of the second cylinder 121T to be communicated with the upper muffler chamber 180T. The second outlet 190T is provided with a second outlet valve (not illustrated) that prevents the backflow of compressed refrigerant gas.

A second outlet valve holder (not illustrated) is arranged overlapping the second outlet valve to control the flexural opening amount of the second outlet valve. The second outlet valve holder is fixed by a rivet together with the second outlet valve. The upper muffler chamber 180T reduces the pressure pulsation of discharged refrigerant gas.

The first cylinder 121S, the lower end plate 160S, the lower muffler cover 170S, the second cylinder 121T, the upper end plate 160T, the upper muffler cover 170T, and the partition 140 are integrally fixed by a bolt 175. Among those integrally fixed by the bolt 175 in the compressing unit 12, the outer circumference of the upper end plate 160T is fixed to the compressor housing by spot welding such that the compressing unit 12 is fixed to the compressor housing.

Although not illustrated, in the outer circumference wall of the cylindrical compressor housing, first and second through holes are formed in this order from the bottom to be separated from each other in the axial direction to pass first and second inlet pipes therethrough. Besides, on the out side of the compressor housing, an accumulator formed of an independent cylindrical sealed container is supported by an accumulator holder and an accumulator band.

The top center of the accumulator is connected to a system connecting pipe connected to the low pressure side of the refrigeration cycle. First and second low-pressure communication pipes are connected to a bottom through hole provided in the bottom of the accumulator. An end of the first and second low-pressure communication pipes extends to the upper part of the inside of the accumulator, while the other is connected to an end of the first and second inlet pipes.

The first and second low-pressure communication pipes that guide low pressure refrigerant of the refrigeration cycle to the first compressing unit 12S and the second compressing unit 12T are connected to the first inlet hole 135S of the first cylinder 121S and the second inlet hole 135T of the second cylinder 121T (see FIG. 3), respectively, via the first and second inlet pipes as inlet portions. That is, the first inlet hole 135S and the second inlet hole 135T are connected in parallel to the low pressure side of the refrigeration cycle.

The top center of the compressor housing is connected to an outlet pipe that is connected to the high pressure side of the refrigeration cycle to discharge high pressure refrigerant gas to the high pressure side of the refrigeration cycle. That is, the first outlet 190S and the second outlet 190T are communicated with the high pressure side of the refrigeration cycle.

Lubricant oil is retained in the compressor housing up to about the height of the second cylinder 121T. By a vane pump (not illustrated) located below the shaft 15, the lubricant oil circulates in the compressing unit 12 to lubricate sliding components and seal the point that partitions the compression space of compressed refrigerant gas by a small gap.

In the following, a description will be given of the characteristic structure of the rotary compressor 1. The rotary compressor 1 of the embodiment is provided with a first pin hole 310S and a second pin hole 310T. The first pin hole 310S is located on the outer circumferential side of the first back pressure chamber 129S (the end of the first vane groove) provided to the first flared portion 122S of the first cylinder 121S. The second pin hole 310T is located on the outer circumferential side of the second back pressure chamber 129T (the end of the second vane groove) provided to the second flared portion 122T of the second cylinder 121T. The first pin hole 310S and the second pin hole 310T cross a first spring hole 124S and a second spring hole 124T, respectively. A spring holder pin 300 is inserted through the first pin hole 310S and the second pin hole 310T to prevent the first spring 126S and the second spring 126T pushed into the first spring hole 124S and the second spring hole 124T, respectively, from coming off when the first compressing unit 12S and the second compressing unit 12T are installed in the compressor housing. The spring holder pin 300 includes a handle 301.

Upon assembling the rotary compressor 1, as illustrated in FIG. 2, after assembling the compressing unit 12, the operator pushes the first spring 126S and the second spring 126T into the first spring hole 124S and the second spring hole 124T, respectively. Then, while holding the handle 301, the operator inserts the spring holder pin 300 through the first pin hole 310S and the second pin hole 310T to prevent the first spring 126S and the second spring 126T from coming off the first spring hole 124S and the second spring hole 124T, respectively.

In this state, to install the compressing unit 12 in the compressor housing, the operator installs the second compressing unit 12T first in the compressor housing. After that, the operator removes the spring holder pin 300, and the base of the first spring 126S and the second spring 126T is supported by the inner circumferential wall of the compressor housing. Thus, the compressing unit 12 is installed in the compressor housing. In the rotary compressor 1 of the embodiment, the spring holder pin 300 is inserted through the first pin hole 310S and the second pin hole 310T provided on the outer circumferential side of the first back pressure chamber 129S and the second back pressure chamber 129T (the ends of the first and second vane grooves) to hold the first spring 126S and the second spring 126T. This requires less pushing amount of the first spring 126S and the second spring 126T, thereby facilitating the assembly work.

While the embodiment is described by way of example as being applied to a twin rotary compressor in which the first compressing unit 12S and the second compressing unit 12T are connected in parallel to the refrigeration cycle, it is not so limited. The embodiment may be applied to a two-stage rotary compressor in which the first compressing unit 12S and the second compressing unit 12T are connected in series to the refrigeration cycle or a single rotary compressor having a single compressing unit. The single rotary compressor does not need first and second components as described in the embodiment.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A method of manufacturing a rotary compressor comprising a compressor unit, the compressing unit including:

a first annular cylinder including a first flared portion to provide a first inlet hole and a first vane groove;

a second annualar cylinder including a second flared portion to provide a second inlet hole and a second vane groove;

a lower end plate and a partition to seal cylinder ends of the first annular cylinder;

the partition and an upper end plate to seal cylinder ends of the second annular cylinder;

a first annular piston held by a first eccentric portion of a rotation shaft rotationally driven by a motor, a second annular piston held by a second eccentric portion of the rotation shaft, the first annular piston revolving along a first cylinder inner wall in the first annular cylinder, the second annular piston revolving along a second cylinder inner wall in the second annular cylinder, a first operation chamber being formed between the first cylinder inner wall and the first annular piston, a second operation chamber being formed between the second cylinder inner wall and the second annular piston;

a first vane protruding from the first vane groove provided to the first flared portion of the cylinder into the first operation chamber and coming in contact with the first annular piston to partition the first operation chamber into an first inlet chamber and a first compression chamber;

a second vane protruding from the second vane groove provided to the second flared portion of the cylinder into the second operation chamber and coming in contact with the second annular piston to partition the second operation chamber into an second inlet chamber and a second compression chamber;

a first spring and a first spring hole formed in a back of the first vane groove;

a second spring and a second spring hole formed in a back of the second vane groove; and a first pin hole located on an outer circumferential side of an end of the first vane groove provided to the first flared portion of the first annular cylinder and crossing the first spring hole, a second pin hole located on an outer circumferential side of an end of the second vane groove provided to the second flared portion of the second annualar cylinder and crossing the second spring hole, the method comprising: inserting the first spring into the first spring hole to press a back of the first vane, inserting the second spring into the second spring hole to press a back of the second vane, inserting a spring holder pin including a handle through the first pin hole and the second pin hole in such a manner that the handle is located on an opposite side of the motor, while holding the handle to prevent the first and second springs pushed into the respective first and second spring holes from coming off when the compressing unit is installed in a compressor housing, and removing the spring holder pin from the first and second pin holes after the compressing unit is installed in the compressor housing.

* * * * *